United States Patent [19]

Pinkau et al.

[11] 4,067,475

[45] Jan. 10, 1978

[54] CONTAINERS FOR FOODSTUFF

[76] Inventors: Wolfgang Pinkau, Heinr. Spath Strasse 6, 4018 Monheim; Alfred Esser, Kolberger Strasse 12, 4005 Meerbusch 2, both of Germany

[21] Appl. No.: 718,550

[22] Filed: Aug. 30, 1976

[30] Foreign Application Priority Data

Aug. 30, 1975 Germany ..... 2538641

[51] Int. Cl.[2] ..... B65D 21/02; B65D 11/18; A63H 33/100

[52] U.S. Cl. ..... 220/23.4; 46/11; 46/25; 206/504; 215/10; 220/4 E; 220/23.6; D9/18; D9/219

[58] Field of Search ..... 220/23.4, 23.6, 4 E; 206/504; D9/18, 219; 46/11, 25, 26; 215/10

[56] References Cited

U.S. PATENT DOCUMENTS

| | | | |
|---|---|---|---|
| 3,374,917 | 3/1968 | Troy | 220/23.4 |
| 3,419,176 | 12/1968 | Liffert | 220/23.6 |
| 3,425,586 | 2/1969 | Petters | 220/23.4 |
| 3,815,281 | 6/1974 | Kander | 220/23.4 |

FOREIGN PATENT DOCUMENTS

| | | | |
|---|---|---|---|
| 1,197,003 | 7/1965 | Germany | 46/25 |
| 2,115,693 | 10/1972 | Germany | 206/504 |

*Primary Examiner*—George E. Lowrance
*Attorney, Agent, or Firm*—Donald D. Jeffery

[57] ABSTRACT

A generally dish-shaped container has a projection or projections at its mouth edge, and a recess or recesses in its bottom or its base, whereby such containers can be secured together to form a structure on a building block principle, by interengagement of the projection and recess. The structure can be formed by securing containers together in pairs at their mouth edges, and then securing two or more pairs together by means of the projection and recess interengagement.

8 Claims, 8 Drawing Figures

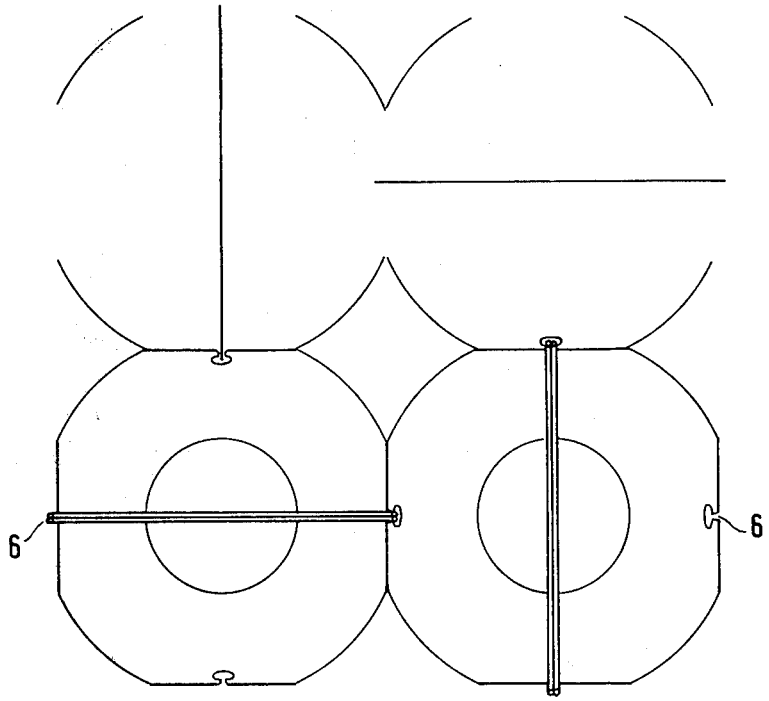
FIG. 5
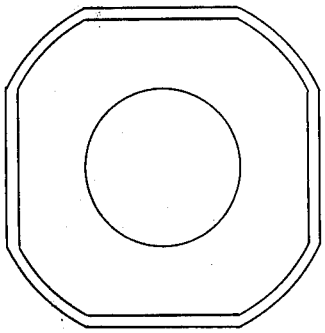
FIG. 4
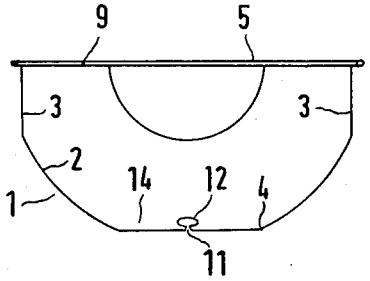

CONTAINERS FOR FOODSTUFF

BACKGROUND OF THE INVENTION

There are already known plastics material containers of a generally cubic shape, for containing for example foodstuffs and luxury foods such as yogurt. Such containers have projections and recesses which can be brought into engagement with each other so that when the containers are empty, a plurality of such containers can be fitted together on the so-called building block principle to compose larger units. Such units then in turn can be used for other purposes, for example as toys, in order in this way to permit multiple re-use and in addition to counteract environmental pollution which would otherwise occur due to the discarding of such throw-away packaging. In these known containers however the corresponding projections and recesses are disposed in the region of the eight corners of the container, so that additional assembly supports and recesses must be provided at the walls of the containers in order for the combined units formed by such containers to achieve a sufficient degree of stability. However such supports and recesses make it more difficult to combine such containers together and thus limit the range of possible re-uses.

SUMMARY OF THE INVENTION

An object of the invention is to provide a container of a generally dish-like shape for receiving and storing foodstuffs and luxury foods, which can be combined, either singly or in pairs, with similar containers, thereby acting as building blocks to compose larger units.

A further object of the invention is to provide containers so shaped that after the container content has been consumed, such containers can be fitted together in pairs to form generally cube-shaped building blocks which in turn can be readily combined together to form larger structures of various kinds and configurations.

Yet a further object of the invention, is to provide a container with means whereby a plurality of such containers can be secured together to form an easily manipulatable unit.

The invention provides a container which is generally dish-shaped with a bottom or base, for example of the pedestal kind. The mouth edge at the opening of the container has one or more projections so that, when two such containers are fitted together with the said edges against each other to form a building block, the adjoining projections of the two containers, or one projection of one of the two containers, can be positively engaged into a recess in a further container or one of a pair of interconnected further containers, to form a larger unit, which recesses are provided in the bottom or base of the respective container.

The projection at the edge of the container can be a peripheral continuous bead, and handling is facilitated if each projection is a continuous peripheral bead and the recess in each container is arranged for receiving two beads adjacent to each other, as when two such containers are fitted together. Thus, when the projection on each container is a bead as just mentioned, when two such containers are fitted together to form a said building block, it is not necessary to ensure that the containers are in any given position relative to each other, provided that the two beads lie closely against each other and can thereby be engaged jointly into the appropriate recess.

The recess in the container bottom or base can be a single rectilinear groove, or a groove of generally cross-shaped configuration; alternatively the bottom of the container can have an annular flange provided with two recesses at diametrally opposed positions, for receiving one or two projections of containers, which is or are to be secured within said recesses.

This construction means that the shape of the remainder of the container can be varied, apart from the provision and the positioning of the recesses, for example so that two containers can be fitted together to form either a substantially cube-shaped building block or a generally spherical building block.

When two building blocks, each formed by a pair of containers, are secured together by at least a part of the projections of the two containers of one of the building blocks being jointly engaged into a recess in the other building block, this engagement will also serve to secure together the two containers forming the building block, without further coupling or retaining means. However, the edge or rim of each container may also have at least one projection and at least one recess complimentary to said projection, forming coupling means, so that when two such containers are put together, such coupling means come into engagement whereby the two containers or cartons can be connected together with a high degree of stability and can be easily handled.

By virtue of the construction of the invention, the recesses in the container bottom or base and the projections or retaining elements which are to be engaged into such recesses, for the purposes of composing larger units from a number of building blocks, each of which is formed from a pair of containers, can always be on walls of the generally cube-shaped building blocks, which are perpendicular to each other. This accordingly ensures a sufficient degree of stability of the composite units, without additional coupling elements being required to secure the dishes together in the building blocks or in the larger unit.

It has been found that complicated structures of many different kinds can be made up without difficulty by combining such containers, after their contents have been consumed. In additon, because of the preferably symmetrical distribution of the recesses and the projections or retaining elements which engage into such recesses, the containers have a pleasant aesthetic impression. The projections which are disposed at the dish edge and thus forming the retaining elements, are desirably provided at at least two oppositely located edges of the container, so that they can at least partly engage into the recesses formed in the container bottom or base.

The containers can be yoghurt cartons, ice cream cartons or other cartons for foodstuffs, and/or luxury foods; in general such cartons will in any case have an edge or rim for securing a sealed closure foil which is removed before the carton contents are consumed.

BRIEF DESCRIPTION OF THE DRAWINGS

FIG. 4 shows plan and side views of a second embodiment of a container, FIG. 5 shows a part of a unit or structure formed by building blocks each comprising two of the containers of FIG. 4.

DESCRIPTION OF THE DRAWINGS

Figure 1:
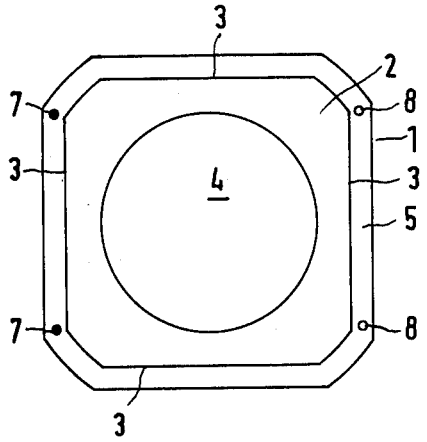
FIG. 1 shows a plan view of a first embodiment of a container.
Figure 2:
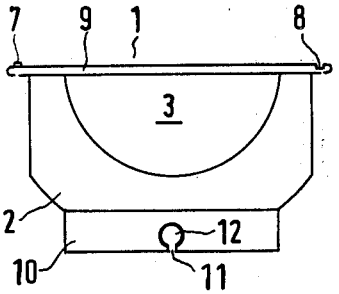
FIG. 2 shows a side view of the container of FIG. 1.

The container 1 shown in FIGS. 1 and 2 is of a generally dish-like configuration, comprising a dish-shaped wall 2 with flat side surfaces 3 of part-circular form, and a flat round bottom 4. At the mouth of the dish defined by the wall 2 is an at least outwardly projecting, free-standing peripheral edge or rim portion 5 on which lies a sealing closure foil (not shown) which is connected to the edge 5, when the container is full. After the closure foil has been removed and the container 1 has been emptied, two such containers can be joined together to form a so-called building block, at 6 in FIG. 3, the pair of containers being laid one upon the other so as to be in contact with each other at their edges 5. For the purposes of locating the edges 5 relative to each other and connecting them together, each container has coupling elements in the form of one or more projections 7 and one or more recesses 8, the projections 7 of each container engaging into the recesses 8 of the respective other container. Projections 7 and recesses 8 are desirably so shaped that they provide a retaining action when the projections 7 are introduced into the recesses 8 to secure the containers in the assembled condition. The two interconnected containers 1 form a building block 6 of substantially cube-like configuration.

Figure 3:
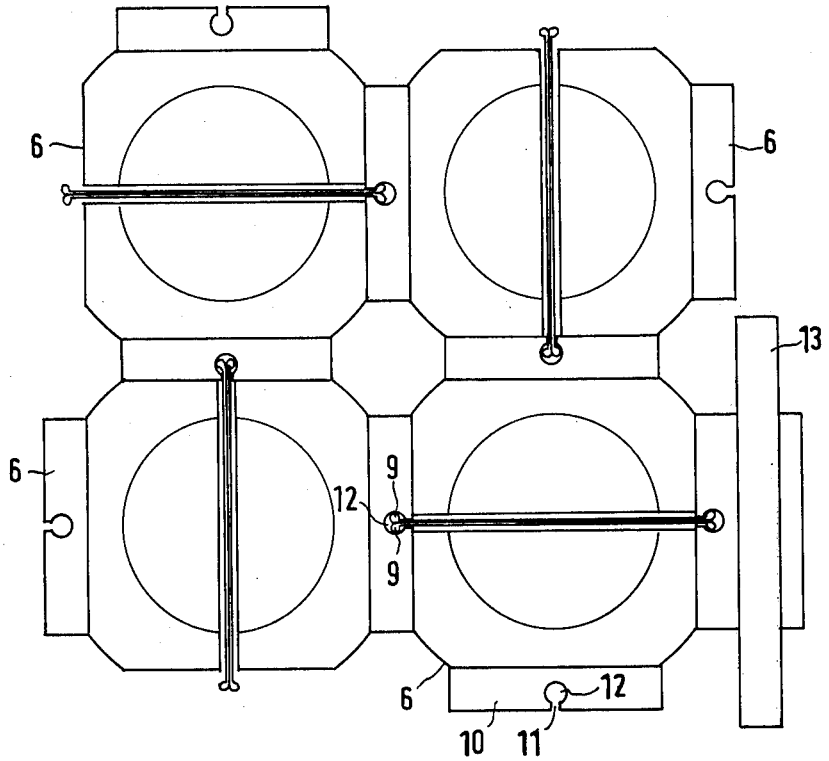
FIG. 3 shows a portion of a unit or structure formed by a plurality of building blocks, each such block comprising two conjoined containers as shown in FIGS. 1 and 2.

The edge 5 of each container 1 carries a continuous peripheral bead 9 which, together with the part of the edge 5 which projects beyond the wall 2, forms a projection portion which can be introduced into a retaining and connecting recess in the bottom 4 of another container. As shown in FIGS. 2 and 3, the bottom 4 of each container carries a base support portion in the form of an annular flange 10 which at diametrically opposed positions has slots as at 11, each opening into a round section recess 12.

As is particularly clearly shown in FIG. 3, the beads 9 of two containers 1 which are fitted together to form a building block 6 can be introduced into the recesses 12, and the building blocks 6 are thereby joined together. Further building blocks can be connected to the structure shown in FIG. 3 without difficulty, in any desired arrangement, because each annular flange 10 has as least two recesses at at 12, although only one recess is visible in FIGS. 2 and 3 in each container. There is also the possibility of providing additional element on the FIG. 3 structure, for example a disc 13 acting as a wheel, which is fitted onto an annular flange 10. The disc 13 may also have an annular flange 10 with a recess arrangement 11, 12, and the diameter of the disc 13 is greater than the height of a building block 6 (see FIG. 3).

The embodiment shown in FIGS. 4 and 5 is similar to that of FIGS. 1 to 3, and the same references denote similar components. However, unlike the above-described embodiment of FIGS. 1 to 3, the dish edges 5 do not have any projections 7 and recesses 8, so that when the containers 1 are fitted together and lie one upon the other in contact at their edges 5, the containers are held in the assembled condition by the beads 9, or the adjoining parts of the edges 5, being engaged and gripped in the recesses 12 of the adjacent building block 6. An adhesive may also be applied to secure the containers together.

Disposed in each container bottom 4 is a recess 12 in the form of a continuous rectilinear groove extending along a diameter of the container bottom.

Figure 8:
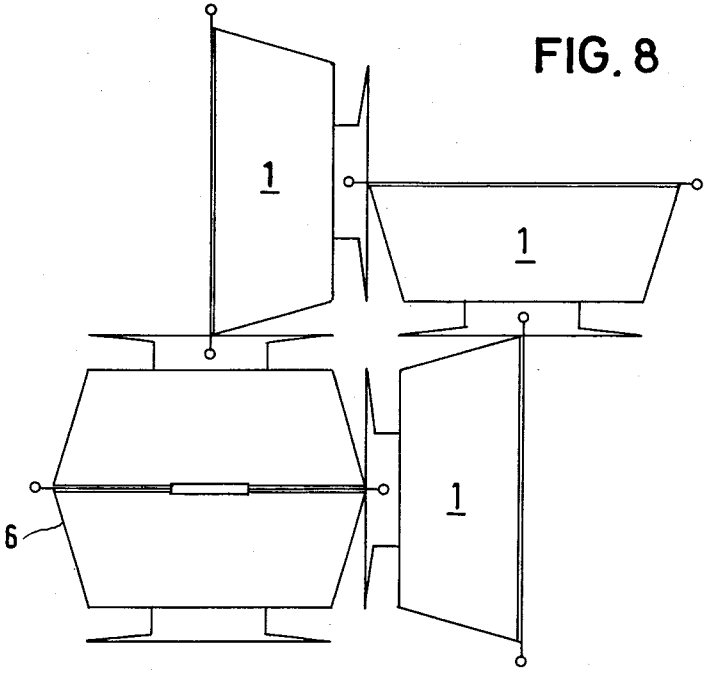
FIG. 8 shows a part of a structure formed by containers as shown in FIGS. 6 and 7.
Figure 7:
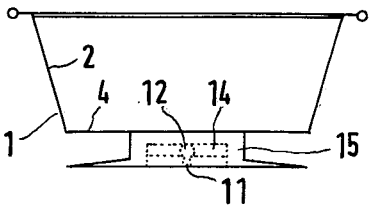
FIG. 7 shows a side view of the container of FIG. 6.
Figure 6:
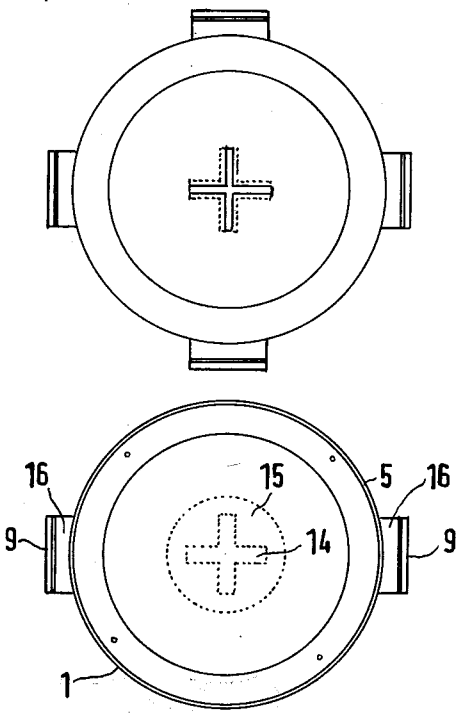
FIG. 6 shows top and underneath views of further embodiments of a container.

The embodiment shown in FIGS. 6 to 8 is a container whose general configuration is that of a truncated portion of a circular cone whose cone surface forms the container wall 2 while the smaller base of the truncated cone forms the bottom 4.

The bottom 4 carries a base 15 of generally pedestal-like form, with a recess in the form of a cross-shaped groove arrangement 14. This provides that one or more other containers can be joined to the container with the groove arrangement 14, in various alternative orientations.

The upper edge of the container 1 is surrounded by a relatively narrow edge or rim 5 which carries at least two outwardly extending claw-like projections 16, each of which terminates in an enlarged bead 9.

After the contents of such containers have been consumed, the containers are fitted in pairs one to the other in such a way as to compose a generally cubic building block 6 which has on each of four sides a respective one of the projections 16 with bead 9. Then the building block 6 can be connected to a further such block or another container, by clamping one of the beads 9 into a recess 12 of the cross-shaped groove 14 in the base 15 of a second building block 6 or container. The part of a structure shown in FIG. 8 shows how building blocks 6 or even individual containers 1 can be joined together to form a larger unit.

Various modifications can of course be made without thereby departing from the scope of the invention as defined by the appended claims.

We claim:

1. A container comprising a generally dish-shaped side wall being formed with a peripheral, laterally projecting free edge at the mouth thereof; recess means formed in said bottom wall means and being entirely within the confines of said bottom wall means, said recess means being sufficiently large that a pair of containers can be superposed mouth-to-mouth and the adjoining projecting edges of said pair of containers engaged into similar recess means in another container, whereby a plurality of such containers can be combined together on a building block principle to form a large structure.

2. The container of claim 1 wherein said laterally projecting free edge is formed with a continuous peripheral bead at its outer peripheral edge, said recess means receiving the superposed beads of said pair of containers.

3. The container of claim 1 wherein said bottom wall means includes an annular base flange and said recess means comprises two recess portions at diametrically opposed positions in said annular flange, adapted to receive said projecting edges of said superposed pair of containers.

4. The container of claim 1 wherein said peripheral free edges of each container are formed with a pair of upwardly extending projections and mating recesses in the opposite edge portions thereby to provide a retaining action through engagement of projections of a superposed container into the recesses of a bottom container, and vice-versa, when the containers are superposed to form a building block of generally cube-like configuration.

5. The container of claim 1 wherein said recess means includes relatively narrow slots openings into generally large recesses circular in cross-section whereby said projections are retained therein.

6. The container of claim 1 wherein said laterally projecting free edge is formed with a continuous peripheral bead at its outer peripheral edge, said recess means receiving the superposed beads of said pair of containers, said bottom wall means includes an annular base flange and said recess means comprises two recess portions at diametrically opposed positions in said annular flange, adapted to receive said projecting edges of said superposed pair of containers, and wherein said peripheral free edges of said container are formed with a pair of upwardly extending projections and mating recesses in the opposite edge portion thereby to provide a retaining action through engagement of projections of a superposed container into the recesses of a bottom container, and vice-versa, when the containers are superposed to form a building block of generally cube-like configuration.

7. A container having a generally conical side wall and a flat bottom wall, a pedestal base extending below said bottom wall, said side wall being formed at the mouth thereof with a plurality of arcuate, circumferentially spaced projections the ends of which are formed with beads, recess means formed in the bottom of said pedestal base and entirely within the confines thereof; said recess means being cross-shaped in cross section and being sufficiently large that a pair of containers can be superposed mouth-to-mouth and the adjoining projections of said pair of containers engaged into one leg of a similar cross-shaped recess means in another container, whereby a plurality of such containers can be combined together on a building block principle to form a large structure.

8. The container of claim 7 wherein said recess means includes relatively narrow slots opening into generally large recesses circular in cross-section whereby said projections are retained therein.

* * * * *